US005649658A

United States Patent [19]

Hoffman et al.

[11] Patent Number: 5,649,658

[45] Date of Patent: Jul. 22, 1997

[54] BACKPACK HAVING DETACHABLE INFANT CHANGING PAD

[75] Inventors: Valerie L. Hoffman, Merritt Island; Carol A. Gornto, Rockledge, both of Fla.

[73] Assignee: Nappie Sak, Inc., Cocoa, Fla.

[21] Appl. No.: 398,645

[22] Filed: Mar. 3, 1995

[51] Int. Cl.[6] ..... A45F 4/02

[52] U.S. Cl. ..... 224/576; 224/153; 224/653; 224/901.6; 190/2

[58] Field of Search ..... 224/151, 153, 224/155, 156, 209, 259, 264, 575, 576, 627, 645, 650, 659; 383/4, 113; 190/1, 2; 5/420, 655, 656, 473, 417

[56] References Cited

U.S. PATENT DOCUMENTS

| | | | |
|---|---|---|---|
| 2,738,834 | 3/1956 | Jaffe et al. | 5/420 |
| 2,751,609 | 6/1956 | Oesterling et al. | 5/420 |
| 2,834,970 | 5/1958 | Nappe | 5/420 |
| 4,154,323 | 5/1979 | Sneider | 190/2 |
| 4,325,469 | 4/1982 | Gurian | 383/113 |
| 4,767,039 | 8/1988 | Jacober | 224/151 |
| 5,022,574 | 6/1991 | Cesari | 224/153 |
| 5,361,951 | 11/1994 | Chehebar | 224/153 |

FOREIGN PATENT DOCUMENTS

| | | | |
|---|---|---|---|
| 167038 | 4/1950 | Austria | 224/209 |
| 2197582 | 5/1988 | United Kingdom | 224/209 |

*Primary Examiner*—Henry J. Recla
*Assistant Examiner*—Gregory M. Vidovich
*Attorney, Agent, or Firm*—Charles E. Wands

[57] ABSTRACT

A backpack is comprised of a plurality of compartments for permitting storage of and easy access to a variety of infant care-associated products, and includes a detachable waterproof changing pad, which may be readily stored within and unfolded from an auxiliary backpack compartment, so as to provide the parent-wearer with an easy to carry and use, infant changing station.

12 Claims, 3 Drawing Sheets

BACKPACK HAVING DETACHABLE INFANT CHANGING PAD

FIELD OF THE INVENTION

The present invention relates in general to portable storage cases, bags and the like, and is particularly directed to a new and improved backpack configuration, that is equipped with a plurality of storage compartments for storing a variety of infant care-associated products, and includes a detachable waterproof changing pad, which may be readily stored within and unfolded from the backpack, so as to provide the wearer with an easy to carry and use, infant changing station.

BACKGROUND OF THE INVENTION

To accommodate the needs of the widest variety of users, general application, portable storage cases and bags customarily contain a main (usually zippered) compartment, and one or more auxiliary compartments, and may include hand-grips and a shoulder strap for ease of transport. Where unencumbered movement is a prime concern, the storage case may include shoulder straps, and be configured so that it may be worn as a backpack. For special applications, particularly those involving sporting activities, some manufacturers have offered customized storage and transport bag configurations that are designed to accommodate a particular type of user's appliance (e.g., sports equipment, such as a tennis racket). However, none is known to offer a backpack that practically serves the needs of parents with very young children, in particular, infants, who cannot take care of themselves. As parents will attest, when traveling with infants, it is essential to take along an assortment of infant nutrition and hygiene products, so that one is always prepared to attend to the needs of the child, whenever and wherever they arise.

SUMMARY OF THE INVENTION

In accordance with the present invention, such a need is successfully addressed by a new and improved backpack configuration, that not only includes a plurality of compartments for permitting storage of and easy access to a variety of infant care-associated products, but it also includes a detachable waterproof changing pad, which may be readily stored within and unfolded from an auxiliary backpack compartment, so as to provide the parent-wearer with an easy to carry and use, infant changing station.

Pursuant to an exemplary embodiment, the backpack according to the present invention comprises a first, main storage compartment and a second, auxiliary 'changing table' storage compartment, each of which is formed of sewn together back wall, top wall, side wall and bottom wall portions. The bag may comprise any fabric material conventionally used for lightweight, durable storage bag and pack construction, such as waterproof nylon or polyester.

The top wall portion of the main compartment has two sections arranged side-by-side, which are attached by a nylon zipper, that affords entry and waterproof sealable closure to its interior. An adjustable shoulder harness is attached to lower corners and to a central location of a top of the back wall portion of the main compartment. The side wall portions of the main compartment are provided with pockets. A top portion of the interior of the main compartment includes a zippered pouch, while a lower portion of the main compartment has a pouch with an expandable top closure. One or more elastic strap loops may be sewn into the bottom interior region of the main compartment, for releasably securing containers such as bottles and the like. For fabric protection and to prevent leakage, each of the interior wall surfaces of the main compartment is preferably covered with a layer of liquid-impenetrable material, such as clear vinyl.

The top and side wall portions of the auxiliary, 'changing table' compartment are formed as a continuous zipper-closured access panel, that affords a 'wrap-around' entry and waterproof sealable closure to the interior of the auxiliary compartment. The interior of the back wall portion of the auxiliary compartment may include or more more pouches with expandable top closures. Unzipping the auxiliary compartment allows the front wall portion to open outwardly from the bottom wall portion, exposing a folded, detachable waterproof changing pad. The changing pad is made of vinyl cover material with an insert of a foldable layer of cushioning material, such as a foam insert, so that the pad may be folded into a relatively flat and compact configuration, and nested against the interior of the front wall section of the auxiliary compartment when stowed.

Attached to one edge of the changing pad is a strip of hook/loop fastener material. A complementary attachment loop/hook fastener strip is sewn into a bottom interior edge region of the bottom of the auxiliary compartment, so that the changing pad may be detachably fastened to the interior of the auxiliary compartment, and unfolded from the backpack into an infant 'changing station'.

DETAILED DESCRIPTION

Figure 1:
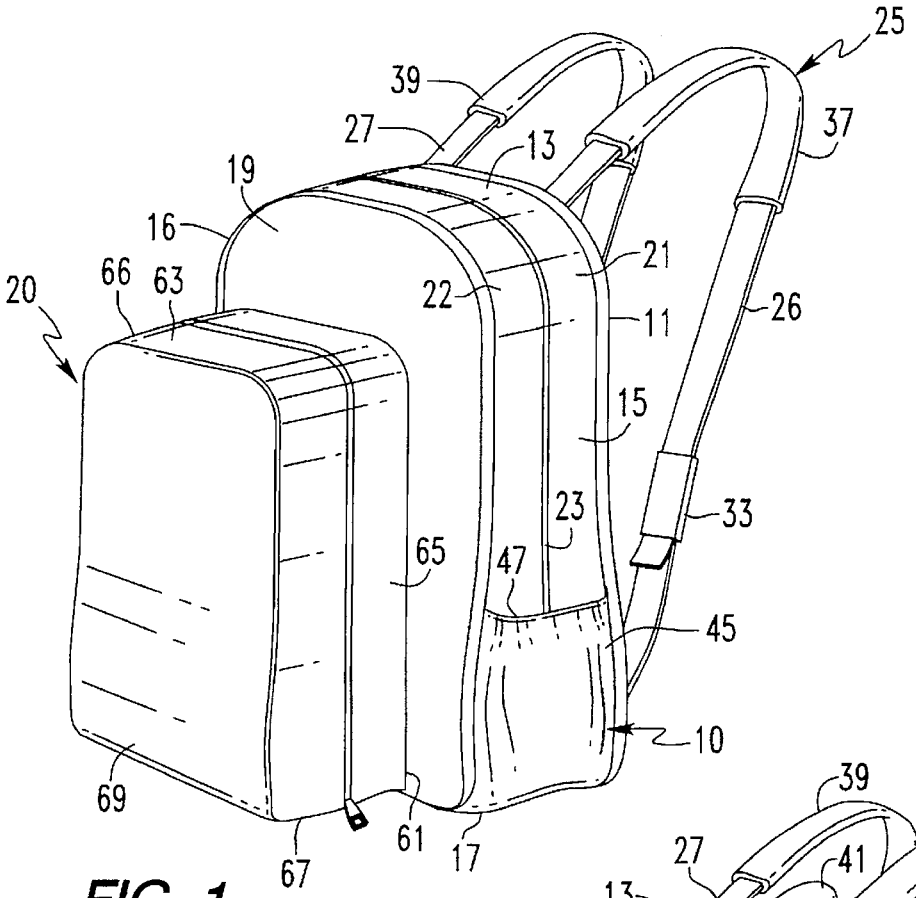
FIG. 1 is a diagrammatic perspective front view of a backpack in accordance with an embodiment of the present invention.

As pointed out briefly above, the backpack according to the present invention is configured to include a plurality of compartments that facilitate storage and easy access to a variety of infant care-associated products, and also includes a detachable waterproof changing pad, which may be readily stored and unfolded from the backpack, so as to provide the parent-wearer with an easy to carry and use, infant changing station.

With attention is directed to FIGS. 1–6 of the drawings, an embodiment of a backpack in according to the present invention is diagrammatically illustrated as having a principal storage compartment 10 formed of a back wall portion 11, a top wall portion 13, respective side wall portions 15 and 16, a bottom wall portion 17, and a front wall portion 19. An auxiliary, 'changing table' compartment 20, to be described, is attached to the front wall portion 19. The material of which the bag is made may comprise any material conventionally used for lightweight, durable storage bag and pack construction, such as waterproof nylon or polyester fabric.

Figure 2:
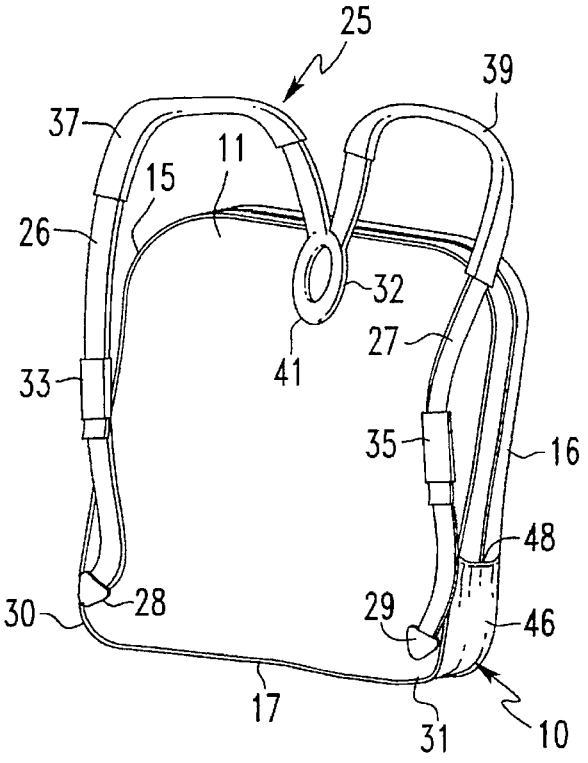
FIG. 2 is a diagrammatic perspective back view the backpack of FIG. 1.

As shown in FIGS. 1 and 2, the back wall portion 11 may be formed of a continuous piece of fabric, and attached (for example, sewn) around its perimeter to each of the top wall portion 13, the two side wall portions 15 and 16, and the bottom wall portion 17. The side and bottom wall portions may comprise respective panels of fabric sewn together to form a continuous section of material, the width of which defines the effective depth of the main compartment of the backpack. The top wall portion 13 is formed in two side-by-side sections 21 and 22, which are attached by an access closure, such as a nylon zipper 23, that affords entry and waterproof sealable closure to the interior of the backpack's main compartment 10.

The front wall portion 19 may also be formed of a continuous piece of fabric and, like back wall portion 11, is sewn around its perimeter to one of the two adjacent sections 21, 22 of the top wall portion 13, the two side wall portions 15 and 16, and the bottom wall portion 17. The side and bottom wall portions may comprise respective panels of fabric sewn together to form a continuous section of material, the width of which defines the effective depth of the main compartment of the backpack.

An adjustable shoulder harness 25, formed of a two pairs of lightweight, durable straps 26 and 27, such as one inch wide nylon straps, is attached, via reinforcement fabric tabs 28 and 29, to respective lower corners 30 and 31 of back wall portion 11, and to a generally central, fabric-reinforced region of the adjoined top edge 32 of back wall portion 11 with top wall portion 13. Each pair of straps has a respective buckle 33, 35 for adjusting the size of the harness to comfortably fit the wearer. For additional comfort, the upper straps of each pair are provided with respective lengths of shoulder padding material 37 and 39. A hang-up loop 41 of strap material is joined to the top central region 32 of the back wall portion 11 of the pack.

The side wall portions 15 and 16 are provided with respective panels of the backpack fabric 45 and 46, that are sewn along their side edges, to the seams between the side wall portions and the front and back wall portions 11 and 19, and along their bottom edges to the bottom wall portion 17. Each fabric panel is open at its top, so as to form a respective pocket or pouch 47 and 48. If desired, the top of each pocket may be oversized and gathered with an elastic strap, to form an expandable top closure.

Figure 3:
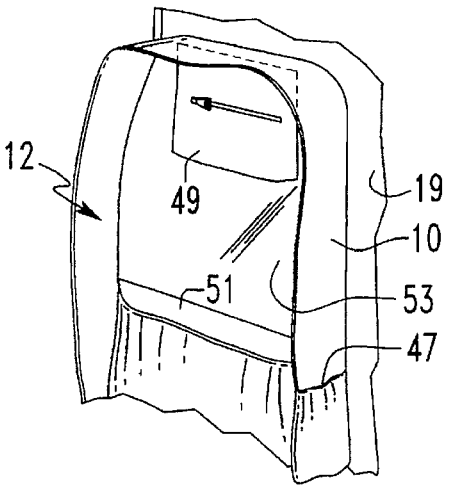
FIG. 3 is a diagrammatic view of a portion of the interior of the main storage compartment of the backpack of FIG. 1.

As shown in FIG. 3, a zippered pouch 49 may be attached to (sewn to a top seam of) an upper portion of the interior 12 of main compartment 10. In addition, a pouch 51 with an expandable top closure may extend across the width of the bottom wall portion 17. One or more elastic strap loops may also be sewn into the bottom interior region of the compartment 10, for releasably securing containers such as bottles and the like within the main compartment. For fabric protection and to prevent leakage, each of the interior wall surfaces of the main compartment is preferably covered with a layer of liquid-impenetrable material 53, such as clear vinyl, that is sewn to the seams between the respective wall portions of the main compartment.

The auxiliary, 'changing table' compartment 20 is configured similar to the main compartment 10, and comprises a back wall portion 61, a top wall portion 63, respective side wall portions 65 and 66, a bottom wall portion 67, and a front wall portion 69. The back wall portion 61 is comprised of the material of the front wall portion 19 of the main compartment 10, described above. For the auxiliary compartment 20, the top and side wall portions 63, 65 and 66 are formed as a continuous zipper-closured access panel, made of two side-by-side sections 71 and 72, which are joined together by a nylon zipper 73, that affords a 'wrap-around' entry and waterproof sealable closure to the interior of the backpack's auxiliary compartment 10. Panel section 71 is sewn to front wall portion 19 of main compartment 10, while panel section 72 is sewn to top and side edges of front wall portion 69, the bottom edge of which is sewn to the bottom wall portion 67 of auxiliary compartment 20. The bottom wall portion 67 is further sewn to the bottom edge of front wall portion 19 of the main compartment. The front wall portion 69 may be formed of a continuous piece of fabric.

The interior 81 of the back wall portion 61 of the auxiliary compartment 20 is provided one or more panels of backpack fabric, such as the two illustrated panels 83 and 85, sewn at their side edges along the seams between the panel section 71 and the front wall portion 19 of the main compartment, and at their bottom edges. Each fabric panel 83 and 85 is open at its top, so as to form a respective pocket or pouch 101 and 102. The panels may be oversized and gathered with an elastic strap to form an expandable top closure.

Figure 4:
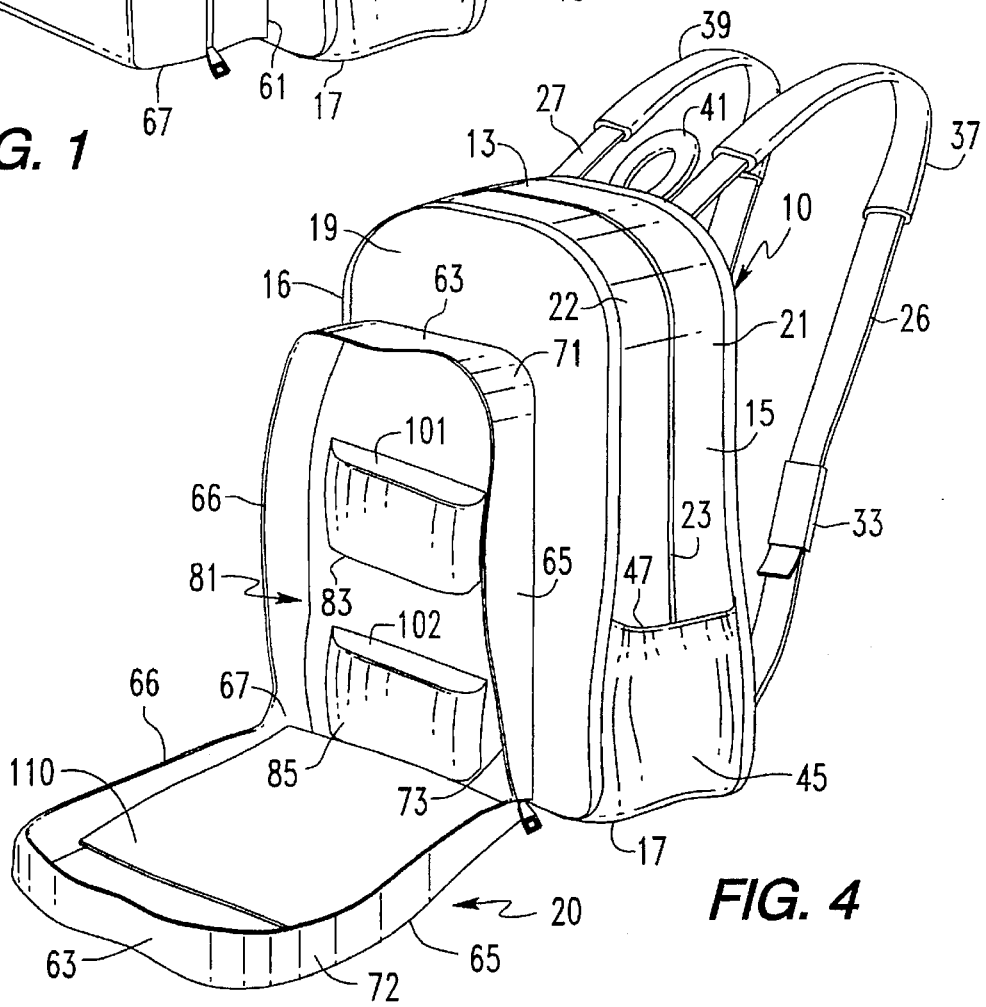
FIG. 4 is a diagrammatic perspective front view of the backpack of FIG. 1, showing the interior of the unzipped auxiliary storage compartment.
Figure 5:
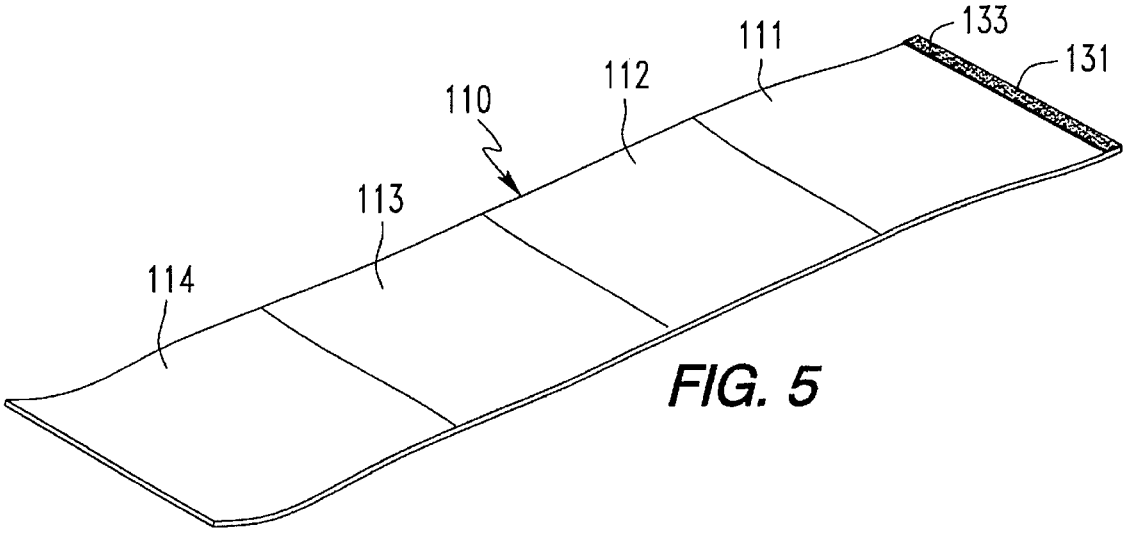
FIG. 5 is a diagrammatic illustration of a foldable changing pad that is detachably fastened in the auxiliary storage compartment shown in FIG. 4.

As shown in FIG. 4, when the auxiliary compartment is unzipped, the front wall portion 69 is able to open outwardly from the bottom wall portion 67 and expose a folded, detachable waterproof changing pad 110. For this purpose, changing pad 110 is made of vinyl material covering a foldable cushioning material, such as a foldable foam insert. As shown in FIG. 5, pad 110 preferably has a plurality of foldable sections 111, 112, 113 and 114 having seams therebetween, that allow the pad to be folded into a relatively flat and compact configuration, so that it may nest against the interior of the front wall section 69 of auxiliary compartment 20 when stowed.

Figure 6:
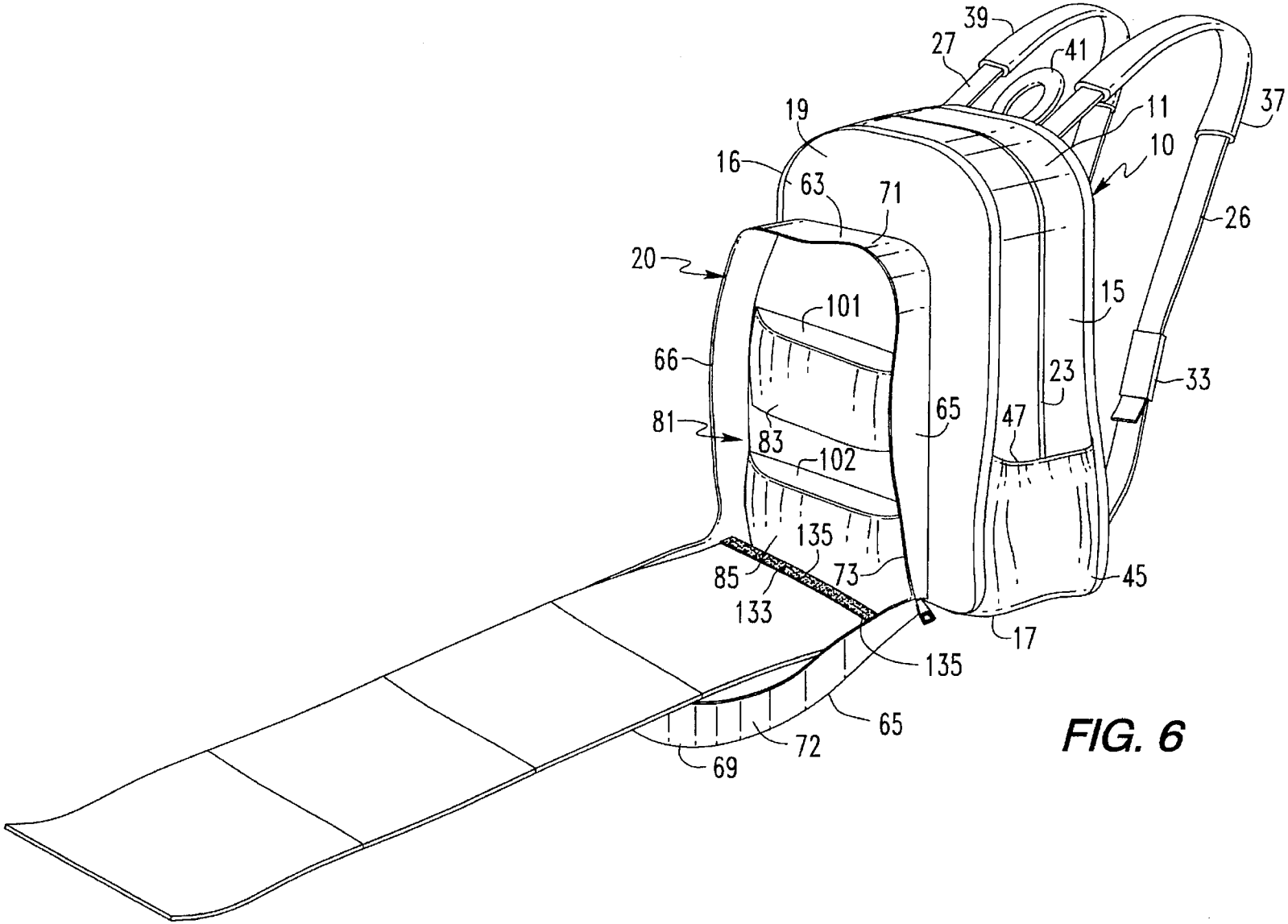
FIG. 6 is a diagrammatic illustration of the backpack illustrated in FIG. 4, with the changing pad unfolded from the auxiliary storage compartment.

Attached to one edge 131 of pad 110 is a strip 133 of hook/loop fastener material. A complementary attachment loop/hook fastener strip 135 is sewn into a bottom interior edge region 137 of bottom wall portion 67. These two complementary hook/loop and loop/hook strips allow the changing pad 110 to be detachably fastened to the bottom of the auxiliary compartment, so that it may be unfolded from the backpack into an infant 'changing station', as shown in FIG. 6, with various infant-related products, such as diapers, powder, astringents, creams, formula bottles, etc., readily accessible from the various storage areas of the bag. Since the changing pad 110 is made of vinyl and is detachable, it is readily removed for easy cleaning and reinstallation.

As will be appreciated from the foregoing description, the backpack according to the present invention meets the previously unsatisfied need for a portable, non-cumbersome storage bag that serves the needs of parents traveling with very young children, by providing a backpack configuration, that is not only equipped with a plurality of compartments for storing a variety of infant care-associated products, but includes a detachable waterproof changing pad, which may be readily stored within and unfolded from the backpack, so as to provide the wearer with an easy to carry and use, infant changing station.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A backpack comprising a plurality of storage compartments, and a waterproof changing pad, which is detachably fastened to, stored within and unfoldable from one of said storage compartments, so as to provide the wearer of said backpack with a portable child-changing station, wherein said plurality of storage compartments include a first, main storage compartment and a second, auxiliary storage compartment, each of which is formed of back wall, top wall, side wall and bottom wall portions, and wherein said top and side wall portions of said auxiliary storage compartment are formed as a continuous zipper-closured access structure, that affords an entry and waterproof sealable closure to the interior of said auxiliary storage compartment, and wherein said detachable waterproof changing pad is attached to said interior of said auxiliary storage compartment and is unfoldable therefrom, so that when said auxiliary storage compartment is unzipped, a front wall portion thereof opens outwardly from a bottom wall portion thereof to allow said waterproof changing pad to unfold from said backpack providing said wearer with said child-changing station, and wherein one end region of said changing pad includes a strip of hook/loop fastener material, and wherein a complementary attachment loop/hook fastener strip is attached to said interior of said auxiliary compartment, so that said changing pad may be detachably fastened to said interior of said auxiliary compartment, and unfolded from the backpack into said child-changing station.

2. A backpack according to claim 1, wherein said changing pad is made of a washable cover material having a foldable cushioning material insert, so that said changing pad may be folded into a relatively flat and compact configuration within said auxiliary storage compartment, and nested against the interior of the front wall section of the auxiliary storage compartment when stowed.

3. A backpack according to claim 1, wherein a top wall portion of main storage compartment includes a zipper closure, that affords access to the interior of said main compartment, and wherein said main storage compartment further includes at least one exterior pouch.

4. A backpack according to claim 1, wherein an interior back wall portion of said auxiliary storage compartment includes one or more storage pouches.

5. A backpack according to claim 1, further including an adjustable shoulder harness attached to lower corners and to a central location of a top region of a back wall portion of said main storage compartment.

6. A backpack according to claim 1, wherein interior wall surfaces of said main storage compartment are covered with a layer of liquid-impenetrable material.

7. A backpack according to claim 1, wherein said main storage compartment further includes a zippered pouch installed at an interior portion thereof.

8. A backpack comprising a first, main storage compartment and a second, auxiliary storage compartment, attached to said main storage compartment, each of said first and second storage compartments having respective back wall, top wall, side wall and bottom wall portions formed of durable, lightweight fabric material, a top wall portion of said main storage compartment having side-by-side sections, which are attachable to one another by a zipper, providing entry and a waterproof sealable closure to the interior of said main storage compartment, an adjustable shoulder harness attached to said main storage compartment, and wherein top and side wall portions of said auxiliary storage compartment are formed as a continuous zipper-closured access panel, that affords an entry and waterproof sealable closure to the interior of said auxiliary storage compartment, and allows said auxiliary storage compartment to be unzipped to cause a front wall portion to open outwardly from a bottom wall portion thereof, and wherein said auxiliary storage compartment further includes a waterproof changing pad containing a foldable layer of cushioning material, said changing pad being detachably fastened at one end region thereof to an interior region of said bottom wall portion of said auxiliary storage compartment, so that said changing pad may be folded into a relatively flat and compact configuration, and nested within the interior of said auxiliary compartment when stowed, and unfolded to a generally flat changing table-like configuration from said interior region of said bottom wall portion of said auxiliary storage compartment, wherein said one end region of said changing pad includes a strip of hook/loop fastener material, and wherein a complementary attachment loop/hook fastener strip is attached to said interior region of said bottom wall portion of said auxiliary storage compartment, so that said changing pad may be detachably fastened to said interior region of said bottom wall portion of said auxiliary storage compartment, and unfolded from said backpack into said changing table-like configuration.

9. A backpack according to claim 8, wherein an interior back wall portion of said auxiliary storage compartment includes one or more storage pouches.

10. A backpack according to claim 8, wherein interior wall surfaces of said main storage compartment are covered with a layer of liquid-impenetrable material.

11. A backpack according to claim 10, wherein the side wall portions of said main storage main compartment are provided with pockets, and wherein the interior of said main storage compartment includes a pouch having an expandable top closure and a zippered pouch.

12. A backpack according to claim 11, wherein an interior back wall portion of said auxiliary storage compartment includes one or more storage pouches.

* * * * *